United States Patent [19]

Kuhlmann

[11] 4,258,612

[45] Mar. 31, 1981

[54] PISTON PUMP FOR CONVEYING CONCRETE MIXES

[75] Inventor: Herbert Kuhlmann, Herne, Fed. Rep. of Germany

[73] Assignee: Wibau, Gruendau-Rothenbergen, Fed. Rep. of Germany

[21] Appl. No.: 969,369

[22] Filed: Dec. 14, 1978

[30] Foreign Application Priority Data

Dec. 21, 1977 [DE] Fed. Rep. of Germany ..... 2757035

[51] Int. Cl.[3] ..... F01B 29/08

[52] U.S. Cl. ..... 92/128; 92/171; 417/900

[58] Field of Search ..... 92/128, 171; 417/900

[56] References Cited

U.S. PATENT DOCUMENTS

| | | | |
|---|---|---|---|
| 1,977,075 | 10/1934 | Magnuson | 92/128 X |
| 2,169,703 | 8/1939 | Mason | 417/900 X |
| 2,366,417 | 1/1945 | MacMillin | 417/900 |
| 2,703,055 | 3/1955 | Veth et al. | 417/900 X |
| 3,046,953 | 7/1962 | Dolza | 92/171 X |
| 3,647,325 | 3/1972 | Johnson | 417/900 X |
| 3,967,542 | 7/1976 | Hall et al. | 417/900 X |

FOREIGN PATENT DOCUMENTS

| | | | |
|---|---|---|---|
| 420660 | 12/1934 | United Kingdom | 92/128 |

*Primary Examiner*—Irwin C. Cohen

*Attorney, Agent, or Firm*—W. G. Fasse; D. F. Gould

[57] ABSTRACT

The present piston pump conveys concrete mixes through, for example, two pump cylinders located in a frame structure so that the cylinder axes extend substantially in parallel to each other. The pump cylinders cooperate with scavenging chambers also installed in said frame structure. To facilitate the assembly and disassembly of said pump cylinders in said frame structure without disassembling the entire frame structure, releasable, form locking connecting elements are operatively arranged between the frame structure and the scavenging chambers whereby the latter may be axially shifted in the frame structure for removing the pump cylinders from their sockets in the frame structure, for example, for maintenance work. Upon insertion of the cylinders into the frame structure, the connecting elements are tightened whereby the pump cylinders are held in position in the frame structure by the connecting means through said scavenging chambers.

3 Claims, 1 Drawing Figure

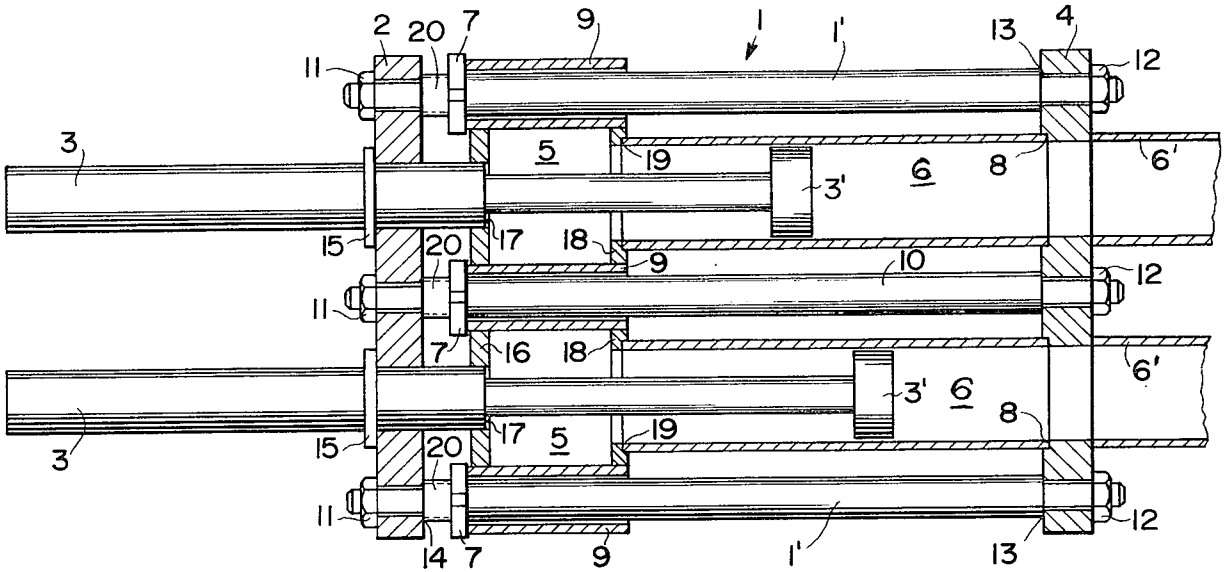
1
1'
2
3
3'
4
5
6
6'
7
8
9
10
11
12
13
14
15
16
17
18
19
20

PISTON PUMP FOR CONVEYING CONCRETE MIXES

BACKGROUND OF THE INVENTION

The present invention relates to piston pumps, particularly for conveying concrete mixes. In such pumps preferably two pump cylinders are arranged in a frame structure so that the cylinder axes extend in parallel to each other. Scavenging chambers are also arranged in the frame structure for cooperation with the respective pump cylinder. Each pump or conveying cylinder is substantially aligned axially with its respective hydraulic drive piston cylinder arrangement.

Swiss Pat. No. 372,927 discloses a pump of the type described above wherein the pump cylinder has flanges at both ends which are connected with the scavenging chamber at one end and to the pump housing or frame structure at the other end thereof. A similar pump cylinder mounting is also disclosed in German Pat. No. 940,198.

The described arrangement of the pump or conveying cylinder between the scavenging chamber and the pump or valve housing is used substantially uniformly in all prior art pumps of this type. Similar considerations apply to the arrangement of the hydraulic drive piston cylinder in axial alignment with the respective pump cylinder. The hydraulic piston cylinder drive is secured to that side of the scavenging chamber which is located opposite the pump cylinder.

Such simple systems have, however, in spite of their clear structure, the disadvantage that the forces effective on the piston cylinder drive are fully transmitted through the pump cylinders, through said flange connections, and through the scavenging chambers to the pump or valve housing or frame structure. Such forces may be within the range of 20 to 30 tons. Hence, it is necessary to statically dimension the scavenging chamber, or chambers, so that it will not be deformed by such forces. Also due to such forces or loads it is necessary to provide a large number of nuts and bolts for securing the above mentioned flange connections. The required dimensions and flange connecting means are expensive and involved to manufacture and it is time consuming, for example, to exchange the conveying or pump cylinders.

OBJECTS OF THE INVENTION

In view of the above, it is the aim of the invention to achieve the following objects singly or in combination:

to avoid the disadvantages of the prior art, specifically to avoid transmitting forces due to the operation of the pump through the scavenging chamber or chambers into the pump frame or housing structure;

to substantially relieve the scavenging chamber of the forces necessary for the pumping operation so that it may be dimensioned substantially only with regard to its own function, that is, for receiving the scavenging liquid such as water;

to facilitate the maintenance and repair work of such pumps, especially to make possible the replacement of the conveying cylinders in a rapid and simple manner;

to construct the concrete pump in such a manner that simple, easily made, inexpensive and easily exchangeable pump cylinders may be used;

to arrange the scavenging chambers for displacement along guide and clamping rods so that the pump cylinders may be taken out or inserted into the pump frame when the respective scavenging chamber is displaced from its normal position; and to construct the pump in such a manner that a constant spacing may be maintained between a frame or housing bottom and a so-called cylinder head also forming part of the frame or housing.

SUMMARY OF THE INVENTION

According to the invention there is provided a piston pump for conveying concrete mixtures or similar materials, having a frame structure including base means, cylinder head means and guide tie rod means operatively connecting said base means, and said cylinder head means to form said frame means, whereby said base means and said cylinder head means are held at a fixed spacing from each other, piston cylinder drive means operatively secured to said cylinder head means on one side thereof, scavenging chamber means operatively secured to said guide tie rod means in said frame means, socket means in said scavenging chamber means and in said base means conveying cylinder means operatively held in said socket means and positioned in said frame means in axial alignment with said piston cylinder drive means and with said scavenging chamber means, and adjustable securing means for fixing the position of said scavenging chamber means and of said conveying cylinder means in said frame means whereby, upon loosening of said securing means, said conveying cylinder means may be mounted in or disassembled from said frame means without the need for disassemblying the entire frame means. By simply loosening the adjustable securing means it is possible to shift the scavenging chamber means along the guide tie rod means to thereby increase the spacing between the edge of the scavenging chamber means and the base means sufficiently for the insertion and removal of the conveying cylinder means into the or from the frame structure. Tightening the adjustable securing means operatively positions and holds the conveying cylinder means in the frame structure.

BRIEF FIGURE DESCRIPTION

In order that the invention may be clearly understood it will now be described, by way of example, with reference to the accompanying drawings, wherein the single FIGURE shows a longitudinal sectional view through a piston pump according to the invention.

DETAILED DESCRIPTION OF A PREFERRED EXAMPLE EMBODIMENT AND OF THE BEST MODE OF THE INVENTION

The longitudinal sectional view of the single FIGURE shows a frame structure 1 comprising outer guide tie rods 1' and an inner, preferably central guide tie rod 10 as well as a base 4 and a cylinder head 2. Reduced diameter, threaded ends of the rods 1', 10 provide shoulders 13 and 14 which define a fixed spacing between the base 4 and the cylinder head 2 which are secured to each other by said guide tie rods by nuts 12 and 11 respectively on the threaded tie rod ends.

Piston cylinder drive means 3 are secured to the outer face of the cylinder head 2 by conventional means such as screw bolts (not shown) extending through flanges 15. Conveying pistons 3' extend with their respective piston rods through scavenging chamber means 5 and into conveying cylinders 6 held in the frame structure in accordance with the invention by clamping or tightening means 7, such as threaded nuts 7, position adjustable on threaded sections 20 of the guide tie rods 1', 10, whereby the conventional flange connections for the conveying cylinders 6 are avoided. Thus, it is possible to simply use precision tubing for the cylinders 6 having straight ends cut-off perpendicularly to the longitudinal axis of the respective tubing cylinder 6. This feature is a substantial economic advantage of the invention.

The clamping means 7 cooperate with guide bushings 9 forming part of the scavenging chambers 5. The bushings 9 are slidable along the respective guide tie rods 1', 10 for pressing the scavenging chambers 5 with their inner rings 18 against the corresponding conveying cylinder 6. For properly centering the cylinders 6, the rings 18 have centering shoulders 19 and the base plate 4 has centering shoulders 8. The scavenging chambers 5 have outer closing plates 16 with holes 17, preferably centrally located so that the inner ends of the drive piston cylinders 3 may extend into these holes 17 to centrally align the drive cylinders 3 with the respective scavenging chamber 5 and the corresponding conveying cylinder 6. Holes in the base plate 4 connect the cylinders 6 to respective conduits 6'.

In operation, the cylinders 6 may be removed from or installed in the frame 1 by loosening the nuts 7 taking the cylinders 6 out of the frame without disassemblying the frame 1 itself because the spacing between the inner edge of the scavenging chambers 5 and the base 4 may be increased by sliding the scavenging chambers 5 out of the way. After insertion of another set of cylinders 6 the scavenging chambers are moved back into the cylinder holding position and the nuts 7 are tightened again.

It is an advantage of the invention that the pattern of holes in the cylinder head 2 and the pattern of the holes through the scavenging chambers 5 as well as the pattern of the holes through the base 4 are all the same whereby the manufacturing and assemblying of these concrete pumps is simplified. In addition to their centering function for the cylinders 6, the shoulders 8 and 19 also prevent a lateral excursion of these cylinders 6.

The concrete pump structure of the invention makes sure that the forces exerted by the hydraulic drive piston cylinders 3 are introduced substantially directly through the guide tie rods 1', 10 into the frame structure without loading the conveying cylinders 6 and the scavenging chambers 5.

The rapid exchange of the conveying cylinders and their simple structure in the form of pipe sections with straight ends results in a very economic concrete pump the parts of which, especially the conveying cylinders 6 which are subject to substantial wear and tear, may be easily manufactured.

Although the invention has been described with reference to specific example embodiments, it will be understood that it is intended to cover all modifications and equivalents within the scope of the appended claims.

What is claimed is:

1. A piston pump for conveying concrete or the like, comprising pump frame means including base means, cylinder head means and guide tie rod means rigidly connecting said base means and said cylinder head means to form said frame means, whereby said base means and said cylinder head means are held at a fixed spacing from each other, piston cylinder drive means operatively secured to said cylinder head means on one side thereof, scavenging chamber means, guide bushing means (9) forming part of said scavenging chamber means for slidably securing said scavenging chamber means to said guide tie rod means in said frame means, centering socket means in said scavenging chamber means and in said base means, conveying cylinder means operatively held in said centering socket means and positioned in said frame means in axial alignment with said piston cylinder drive means and with said scavenging chamber means, adjustable securing means including a threaded section (20) on each of said tie rod means between said cylinder head means (2) and said guide bushing means (9) and nut means (7) on each of said threaded sections (20) for fixing the position of said scavenging chamber means and simultaneously of said conveying cylinder means in said frame means by tightening said nut means, and wherein, solely upon loosening of said nut means with said rigid connection of said guide tie rod means to said base means and said cylinder means maintaining said fixed spacing, the guide bushing means and scavenging chamber means are movable so that the axial spacing between said socket means is increased to an extent longer than the axial length of said conveying cylinder means, whereby said conveying cylinder means may be mounted in or disassembled from said frame means without the need for disassembling the entire frame means and without the removal of said scavenging chamber means.

2. The piston pump of claim 1, wherein said conveying cylinder means comprise precision tubing members having ends cut perpendicularly to the longitudinal axis of the precision tubing members.

3. The piston pump of claim 1, wherein said piston cylinder drive means are secured to said cylinder head means opposite said scavenging chamber means whereby the scavenging chamber means are arranged between said conveying cylinder means and said cylinder head means and the latter is arranged between the piston cylinder drive means and the scavenging chamber means.

* * * * *